US006502485B1

(12) United States Patent
Salazar

(10) Patent No.: US 6,502,485 B1
(45) Date of Patent: Jan. 7, 2003

(54) IMPACT RATCHET WRENCH

(76) Inventor: Joe Martin Salazar, 5844 S. La Posada, Pharr, TX (US) 78577

( * ) Notice: Subject to any disclaimer, the term of this patent is extended or adjusted under 35 U.S.C. 154(b) by 0 days.

(21) Appl. No.: 10/084,522

(22) Filed: Feb. 25, 2002

(51) Int. Cl.[7] ..... B25B 19/00
(52) U.S. Cl. ..... 81/463; 173/93.7
(58) Field of Search ..... 81/463, 465, 466, 81/60–63.2, 464; 173/93, 93.5, 93.6, 93.7, 94–97; 29/275

(56) References Cited

U.S. PATENT DOCUMENTS 2,119,968 A * 6/1938 Shaff
3,094,021 A * 6/1963 Young
3,273,428 A * 9/1966 Rudeke
6,006,634 A * 12/1999 Byers ..... 81/465

* cited by examiner

*Primary Examiner*—D. S. Meislin
(74) *Attorney, Agent, or Firm*—Donald W. Meeker

(57) ABSTRACT

A hollow handle is fitted at the end with an offset ratchet wrench housing. A punch rod slidably positioned within the handle with an end protruding may be struck with a hammer or other implement to turn the ratchet. An impact cap over the end of the handle provides a larger target for the hammer. A spring-loaded striking pin pivotally attached to the working end of the punch rod engages and turns the teeth of the ratchet and also can act as the ratchet retainer pin.

9 Claims, 1 Drawing Sheet

IMPACT RATCHET WRENCH

BACKGROUND OF THE INVENTION

1. Field of the Invention

The present invention relates to hand wrenches and in particular to an impact ratchet wrench which functions as a normal hand-operated ratchet wrench and has the additional impact feature enabling a hammer to be used with the invention to loosen a nut or a bolt.

2. Description of the Prior Art

Anyone who has ever used a wrench can understand the frustration of trying to loosen and remove a bolt or nut that is stuck, particularly if it is rusted or painted stuck. Sometimes even using a long lever arm to turn the wrench is not enough.

Very often the bolt or nut is stripped by attempting to loosen it making the task even more difficult, often requiring other types of gripping tools.

Sometimes lubricants, solvents or chemical rust removing compounds or even Coca Cola® can be used to loosen a bolt or nut that is rusted stuck, but it often takes a while for these liquids to work on the rust, and sometimes even that doesn't work.

Impact wrenches provide a more powerful approach to loosening nuts or bolts by applying a high impact force directly applied to the nut or bolt head. Some of these devices are very elaborate and often much more expensive than conventional wrenches. Often a power supply of some kind is needed to operate them.

There have been some attempts to provide hand-operated wrenches with impact means for loosening nuts and bolts.

U.S. Pat. No. 6,006,634, issued Dec. 28, 1999 to Byers, provides a socket wrench with a hand-powered impact drive with a pivotal connection between the head and the ratchet mechanism to enable an impact force to the socket when the handle is pivoted rapidly forcing an element to strike the head to force the head to rotate and includes a releasable lock to prevent relative movement of the head and the ratchet mechanism for using the socket wrench in the conventional manner.

U.S. Pat. No. 6,085,621, issued Jul. 11, 2000 to Nezigane, shows a ratchet wrench with a sliding weight on the handle of the wrench and a pivot connection between a small handled head portion of the wrench and the long handled gripping portion. With the two handle portions positioned at approximately right angles relative to each other and the head of the wrench engaged on a bolt or nut, the user may slide the weight down the long handle of the gripping portion to impact a protruding ridge on the long handle which causes an impact force driving at a right angle to the short handle to release a tight nut or bolt or to tighten a nut or bolt.

U.S. Pat. No. 4,474,091, issued Oct. 2, 1984 to Russ, claims a tap wrench with a spring-loaded hammer housed within an enlarged portion of the wrench handle. The spring has a ratchet and pawl so that when the spring is wound up and released it causes the hammer to tap repeatedly on the side of the wrench handle in an attempt to loosen a nut or bolt.

U.S. Pat. No. 5,109,739, issued May 5, 1992 to Hull et al., describes a slide hammer tool screwed onto a wrench and positioned at a right angle to the wrench handle engaging the nut or bolt. The sliding weight or hammer is moved rapidly down the handle to loosen a nut or bolt.

U.S. Pat. No. 4,864,902, issued Sep. 12, 1989 to Doorley, is for a socket wrench slugging device wherein an elongated ratchet wrench replacement head has a perpendicular arm with a flat side on the weight at the end of the arm, wherein the arm is struck with a hammer to loosen a nut or bolt.

None of the prior art devices provide an impact wrench that enables striking the ratchet with a sharp hammer and punch type blow directly applied to the teeth of the ratchet to spin the ratchet and free the bolt or nut.

SUMMARY OF THE INVENTION

An object of the present invention is to provide an impact ratchet wrench that functions equally well as a box end ratchet wrench and ratchet socket wrench and as an impact wrench.

Another object of the present invention is to provide an impact wrench with a punch the length of the handle which is struck by a hammer to impart a significant tangential force to the ratchet by striking one of the ratchet teeth with the punch to cause the ratchet to tend to spin to release the nut or bolt.

One more object of the present invention is to provide a sizable striking surface at the top of the impact ratchet wrench so that the hammer can be given a full hard swing without the danger of missing the target.

An added object of the present invention is to provide oversize teeth on the ratchet to insure the ratchet will not be damaged by the impact of the punch.

An additional object of the present invention is to provide an impact ratchet wrench which fits variously sized bolts and nuts by using different ratchet heads or variously sized wrench head inserts, or by using differently sized impact ratchet wrenches.

A further object of the present invention is to provide a ratchet wrench which reverses direction by turning over the wrench to the opposite side.

In brief, an impact ratchet wrench has an offset ratchet head and a punch rod running the length of the hollow cylindrical handle of the wrench. The top of the punch rod is elevated above the top of the wrench handle, held up by a spring at the bottom of the punch rod. An impact cap fitting loosely over the top of the wrench handle rests on the top of the elevated punch rod and provides a large target for the hammer to strike.

The impact cap rides on two bolts attached on opposite sides of the top of the wrench handle with the bolts positioned in spiral openings on opposite sides of the impact cap, allowing the impact cap to rotate freely up and down by turning in a spiral.

A spring-loaded striking pin is pivotally attached to the punch rod near the bottom. The spring causes the bottom end of the striking pin to contact one of the teeth of the ratchet.

With the wrench engaging a stuck bolt or nut, hitting the top of the impact cap with a hammer causes the striking pin to strike the ratchet with a sharp impact and cause the ratchet to rotate thereby loosening the bolt or nut.

Normally the ratchet is free to rotate with each ratchet tooth pushing aside the rotatable striking pin as the tooth passes the pin. The pin is then pushed back by the spring to engage the next ratchet tooth. This striking pin may serve as the primary release pin to operate the ratchet.

An advantage of the present invention is that it provides a relatively simple self-contained tool which is an impact wrench and a ratchet wrench enabling normal usage as either a box end ratchet wrench or ratcheted socket wrench. Then when a difficult situation arises with a stuck bolt or nut, the impact ratchet wrench while still engaged on the stuck bolt or nut is simply struck on the top end with a hammer to loosen the bolt or nut which can then be removed by continuing with the wrench action.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
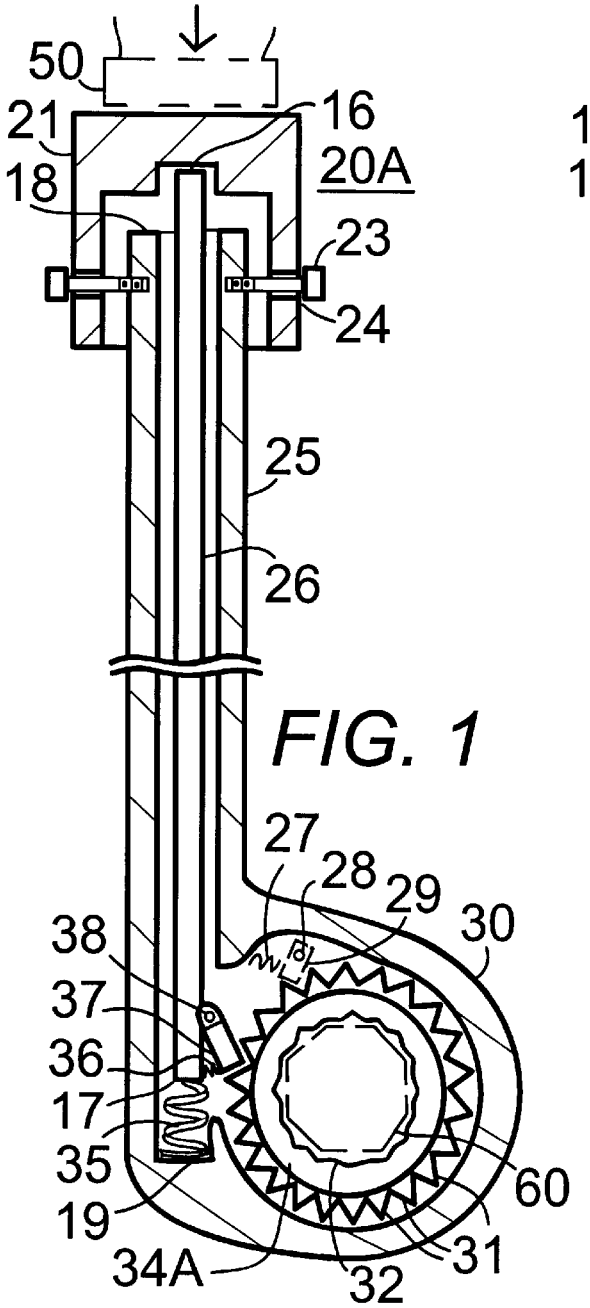
FIG. 1 is a cross-sectional schematic view of the impact ratchet wrench with a box end ratchet wrench head.
Figure 2:
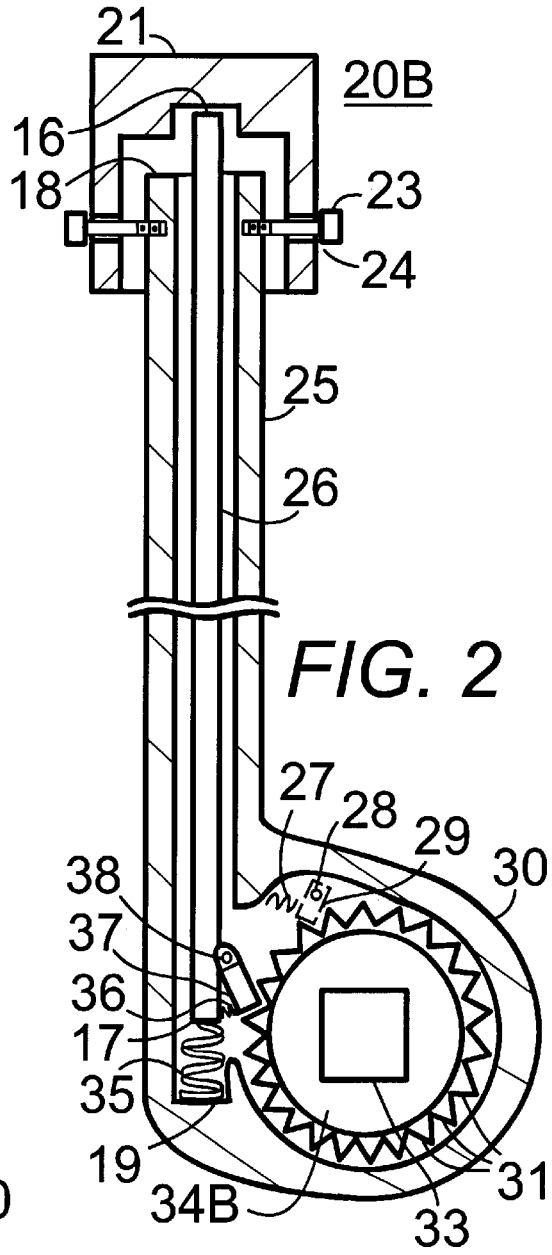
FIG. 2 is a cross-sectional schematic view of the impact ratchet wrench with a ratcheted socket wrench head.

In FIGS. 1 and 2, an impact ratchet wrench 20A and 20B comprises an elongated hollow handle 25 having a top open end 18 and a bottom end 19 terminating in a chamber having an offset circular ratchet housing 30, and a ratchet wrench head 34A and 34B held rotatably within the ratchet housing 30.

A punch rod 26 fits slidably within the handle 25, wherein the punch rod is elevated within the handle by a spring means 35 resting on the bottom 19 of the handle so that a top end 16 of the punch rod protrudes out of the open end 18 of the handle and the punch rod has a ratchet striking means, a striking pin 37 attached by a pivot 38 at a bottom end 17 of the punch rod 26. The ratchet striking means, the striking pin 37, is capable of engaging the ratchet wrench head 34A and 34B so that when a striking force is applied to the top end of the punch rod the ratchet striking means imparts an impact to the ratchet wrench head to turn it.

An impact cap 21 fits slidably over the top 18 of the handle 25 in contact with the top 16 of the punch rod 26, so that striking the impact cap 21, preferably with a hammer 50 (shown dashed) applies a striking force to the punch rod 26.

Figure 4:
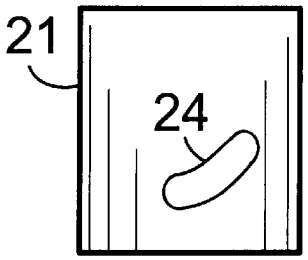
FIG. 4 is a side elevational view of the impact cap showing one of the spiral openings on the side which admits a bolt attached to the top of the wrench handle.

As seen in FIG. 4, the impact cap 21 is provided with at least one elongated opening 24, preferably spiral shaped, through a side of the impact cap 21 and a rigid element from a side of the top end of the handle, preferably a bolt 23 on each side of the handle, protrudes outwardly through the at least one elongated opening 24 and the impact cap 21 rides up and down guided by the rigid element, the bolt 23 in the elongated opening 24 on each side of the impact cap 21.

The ratchet striking means comprises the striking rod 37, pivotally attached to the punch rod 26 adjacent to the bottom end 17 of the punch rod by a pivoting means, such as a pivot pin 38. A spring 36 positioned between the punch rod 26 and the striking pin 37 biases the striking pin 37 into engagement with the ratchet wrench head 34A and 34B.

The ratchet wrench head 34A and 34B is provided with a series of teeth 31 protruding out in a circular array around the ratchet wrench head and the striking pin 37 is normally biased by the spring 36 into engagement with one of the series of teeth 21. The striking pin 37 is capable of being pivoted aside by one of the series of teeth 21 as the ratchet wrench head 34A and 34B rotates on one direction and then biased into engagement with the next one of the series of teeth 21. The striking pin 37 is capable of preventing the ratchet wrench head from rotating in an opposite direction, thereby replacing and serving the function of the usual ratchet retainer pin 29 (shown dashed as optional) attached by a retainer pivot pin 28 and biased against the teeth by a spring 27.

In FIG. 2, the ratchet wrench head 34B comprises a ratchet head with at least one protruding square hub 33 to receive a standard socket wrench head (not shown). Preferably the ratchet wrench head comprises a ratchet head with a protruding square hub 33 to receive a socket wrench head on each of two faces of the impact ratchet wrench to create a reversible wrench.

Figure 3:
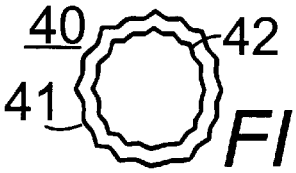
FIG. 3 is a plan view of an insert which may be used with the box end ratchet wrench head of FIG. 1 to adjust the wrench for bolts and nuts of various sizes.

In FIG. 1, the ratchet wrench head 34A comprises a ratchet box end wrench fitting 32. In FIG. 3, the ratchet wrench head further comprises one of a series of wrench head inserts 40 with a perimeter 41 mating with and fitting within the ratchet box end wrench fitting 32 to accommodate differently sized nuts and bolts in a smaller interior box end wrench fitting 41.

Another way to provide for differently sized nuts and bolts is to provide an array of impact ratchet box end wrenches of different sizes.

Preferably the components of the impact ratchet wrench are fabricated of quality stainless steel used in making fine tools.

In operation the impact ratchet wrench 20A and 20B is placed over a nut or bolt and turned to tighten or loosen the nut or bolt. Placing the impact ratchet wrench 20A and 20B with one face down on the nut or bolt enables the nut or bolt to be turned in one direction and turning the impact ratchet wrench 20A and 20B over with the other face down on the nut or bolt enables the nut or bolt to be turned in the other direction. For example, in FIG. 1 if you picture the bolt shaft of bolt head 60 (shown dashed) as going into the page, then the impact ratchet wrench 20A can turn the bolt head 60 in a counterclockwise direction to loosen the bolt. Turning the impact ratchet wrench over would enable turning the bolt head 60 in a clockwise direction, tightening the bolt.

In FIG. 1, if the bolt is stuck and not able to be loosened by turning the handle 25 of the impact ratchet wrench 20A, then a hammer 50 or other implement may be used to hit the impact cap 21 to cause the striking pin 37 to create an impact tangentially on the ratchet wrench head 34A to turn it counterclockwise and thus turn the bolt head 60 counterclockwise abruptly with a strong impact to loosen the bolt. Then the impact ratchet wrench 20A can continue to be turned in a conventional manner with alternating work applying counterclockwise movement to loosen the bolt and ratcheting clockwise movement to reposition the wrench for leverage, thereby removing the bolt. It is understood that the impact ratchet wrench may also be used as an impact tool to tighten nuts and bolts using a hammer, but that is not recommended because of the difficulty in loosening them later.

It is understood that the preceding description is given merely by way of illustration and not in limitation of the invention and that various modifications may be made thereto without departing from the spirit of the invention as claimed.

What is claimed is:

1. An impact ratchet wrench comprising:

an elongated hollow handle having a top open end and a bottom end terminating in a chamber having an offset circular ratchet housing;

a ratchet wrench head held rotatably within the ratchet housing;

a punch rod fitting slidably within the handle, wherein the punch rod is elevated within the handle by a spring means so that a top end of the punch rod protrudes out of the open end of the handle and the punch rod has a ratchet striking means at a bottom end of the punch rod, the ratchet striking means capable of engaging the ratchet wrench head so that when a striking force is applied to the top end of the punch rod the ratchet striking means imparts an impact to the ratchet to turn the ratchet wrench head.

2. The impact ratchet wrench of claim 1 further comprising an impact cap fitting slidably over the top of the handle in contact with the top of the punch rod, so that striking the impact cap applies a striking force to the punch rod.

3. The impact ratchet wrench of claim 2 wherein the impact cap is provided with at least one elongated opening through a side of the impact cap and a rigid element from a side of the top end of the handle protrudes outwardly through the at least one elongated opening and the impact cap rides up and down guided by the rigid element in the elongated opening.

4. The impact ratchet wrench of claim 1 wherein the ratchet striking means comprises a striking rod pivotally attached to the punch rod adjacent to the bottom end of the punch rod by a pivoting means and a spring means positioned between the punch rod and the ratchet striking means biases the ratchet striking means into engagement with the ratchet wrench head.

5. The impact ratchet wrench of claim 4 wherein the ratchet wrench head is provided with a series of teeth protruding out in a circular array around the ratchet wrench head and the ratchet striking means, normally biased by the spring means into engagement with one of the series of teeth, is capable of being pivoted aside by one of the series of teeth as the ratchet wrench head rotates on one direction and then biased into engagement with the next one of the series of teeth, the ratchet striking means being capable of preventing the ratchet wrench head from rotating in an opposite direction.

6. The impact ratchet wrench of claim 1 wherein the ratchet wrench head comprises a ratchet head with at least one protruding square hub to receive a socket wrench head.

7. The impact ratchet wrench of claim 6 wherein the ratchet wrench head comprises a ratchet head with a protruding square hub to receive a socket wrench head on each of two faces of the impact ratchet wrench to create a reversible wrench.

8. The impact ratchet wrench of claim 1 wherein the ratchet wrench head comprises a ratchet box end wrench fitting.

9. The impact ratchet wrench of claim 8 wherein the ratchet wrench head further comprises one of a series of wrench head inserts fitting within the ratchet box end wrench fitting to accommodate differently sized nuts and bolts.

* * * * *